United States Patent [19]

Gropp

[11] Patent Number: 4,898,072

[45] Date of Patent: Feb. 6, 1990

[54] WEAPON AND AMMUNITION CARRIER FOR A GUN

[75] Inventor: Heiko U. Gropp, Hamburg, Fed. Rep. of Germany

[73] Assignee: Rheinmetall GmbH, Düsseldorf, Fed. Rep. of Germany

[21] Appl. No.: 219,972

[22] Filed: Jul. 15, 1988

[30] Foreign Application Priority Data

Jul. 28, 1987 [DE] Fed. Rep. of Germany ..... 3724867

[51] Int. Cl.[4] ..... F41F 9/06; F41F 9/10

[52] U.S. Cl. ..... 89/45; 89/46; 89/47

[58] Field of Search ..... 89/45, 47, 36.13, 34

[56] References Cited

U.S. PATENT DOCUMENTS

| | | | |
|---|---|---|---|
| 3,745,880 | 7/1973 | Metz et al. | 89/43.01 |
| 3,938,421 | 7/1976 | Nordmann | 89/47 |
| 3,986,432 | 3/1976 | Schreckenberg | 89/45 |
| 4,065,999 | 1/1978 | Hultgren et al. | 89/47 |
| 4,388,854 | 5/1983 | Dabrowski et al. | 89/46 |
| 4,587,882 | 5/1986 | Metz | 89/43.01 |
| 4,590,843 | 5/1986 | Huber | 89/36.13 |

FOREIGN PATENT DOCUMENTS

| | | |
|---|---|---|
| 0051119 | 5/1982 | European Pat. Off. . |
| 2027586 | 12/1970 | Fed. Rep. of Germany . |
| 2115535 | 8/1981 | United Kingdom . |

OTHER PUBLICATIONS

"Handbook on Weapontry", published by Rheinmetall GmbH, second English edition (1982), pp. 374–379.

*Primary Examiner*—David H. Brown
*Attorney, Agent, or Firm*—Spencer & Frank

[57] ABSTRACT

A weapon and ammunition carrier for a gun (3) has a housing (1) which is pivotal about an elevation axis (2) to elevate the gun (3). A magazine (8) for ammunition is provided in the housing, and a loading tray (22) is disposed in the housing between the magazine (8) and the gun (3). The magazine (8) is located behind the rear recoil position of the gun (3) and has upper and lower levels. The upper magazine level is configured to hold projectiles (9) in such a manner that the middle projectile (9) is aligned with the axis of the gun barrel (4), and the lower magazine level is configured to hold propelling charges (10). The magazine (8) is provided with a projectile ejector (11) and with a propelling charge ejector (21), with the projectile ejector (11) also serving as rammer. A catching and holding device (12), which can be released in response to operation of the projectile ejector (11), is positioned at the rear recoil position of the gun (3) to releasably lock the gun (3) in the rear recoil position while a projectile (9) is rammed in. A recuperator (26) then axially advances the gun (3) from the rear recoil position to the firing position. The loading tray (22) is disposed at the height of the lower magazine level to receive the propelling charges (10), and is equipped with a parallelogram suspension (23) by means of which the loading tray (22) can be pivoted into position to load the propelling charges (10) into the gun (3).

6 Claims, 2 Drawing Sheets

WEAPON AND AMMUNITION CARRIER FOR A GUN

BACKGROUND OF THE INVENTION

The present invention relates to a weapon and ammunition carrier for a gun. More particularly, the invention relates to a weapon and ammunition carrier of the type that includes a housing which is pivotal about an elevation axis to elevate the gun and which has an ammunition magazine, with a loading tray being positioned between the magazine and the gun.

Such a weapon and ammunition carrier is disclosed in U.S. Pat. No. 3,986,432, in which a magazine for cartridged ammunition is disposed on each side of the gun. A loading tray is provided for each magazine. The loading trays are pivotal from a transfer position behind the respective magazine to a position aligned with the axis of the gun barrel. However, this device is not suitable for producing a fully automatic loading sequence for ammunition which has separate projectiles and propelling charges.

DE-OS (German published, un-examined application) No. 3,046,642 discloses an arrangement of two magazines in an armored turret positioned behind the gun. The cartridged ammunition is received from the magazines alongside or transversely to the gun barrel axis and is subsequently brought into a position suitable for ramming by means of pivotal loading trays disposed in front of the magazines. A rammer is also disposed between the two magazines. This arrangement is also not suitable for separated ammunition.

SUMMARY OF THE INVENTION

It is an object of the present invention to provide a weapon and ammunition carrier, of the type described above in the introductory paragraph, which ensures a fully automatic loading sequence for separated ammunition at a high cadence.

This is accomplished according to the present invention by providing a weapon and ammunition carrier of the above-mentioned type, wherein the magazine has two levels and is disposed behind the rear recoil position of the gun. An upper level of the magazine is provided to receive projectiles such that the middle projectile is aligned with the gun barrel axis. A lower lever of the magazine is provided to receive propelling charges. The magazine also includes a projectile rammer and a propelling charge rammer. A catching and holding device is provided to catch and hold the gun in its recoil position, the catching and holding device being releasable by the projectile rammer after the projectile has been positioned within the gun barrel. A recuperator is provided for axially advancing the gun from the rear recoil position to a firing position to allow a loading tray, which is originally positioned at the lower level of the magazine, to be, pivoted by way of a parallelogram suspension to a loading position behind the gun barrel to load the propelling charge within the gun barrel behind the projectile.

The weapon and ammunition carrier is particularly suitable for large-caliber guns, for example 155 mm howitzers, and permits immediate, fast transportation of a projectile and propelling charge into the active position. The gun and magazine are arranged in a housing at fixed positions with respect to one another. The gun tube or gun barrel has a relatively long recoil, at the end of which the barrel is caught and held so as to allow a projectile to be rammed into the barrel while the propelling charge is held ready by way of a propelling charge loading tray. The entire weapon and ammunition carrier is adjustable in elevation about a common axis of rotation.

With respect to the propelling charge loading tray employed in this case, it should be pointed out that loading trays with parallelogram articulation are known, for example from U.S. Pat. No. 4,388,854. Also recuperators are known as shown for example in the book entitled "Handbook on Weaponry" published by Rheinmetall GmbH, second English edition (1982), pages 374–379.

DESCRIPTION OF THE PREFERRED EMBODIMENT

Figure 1:
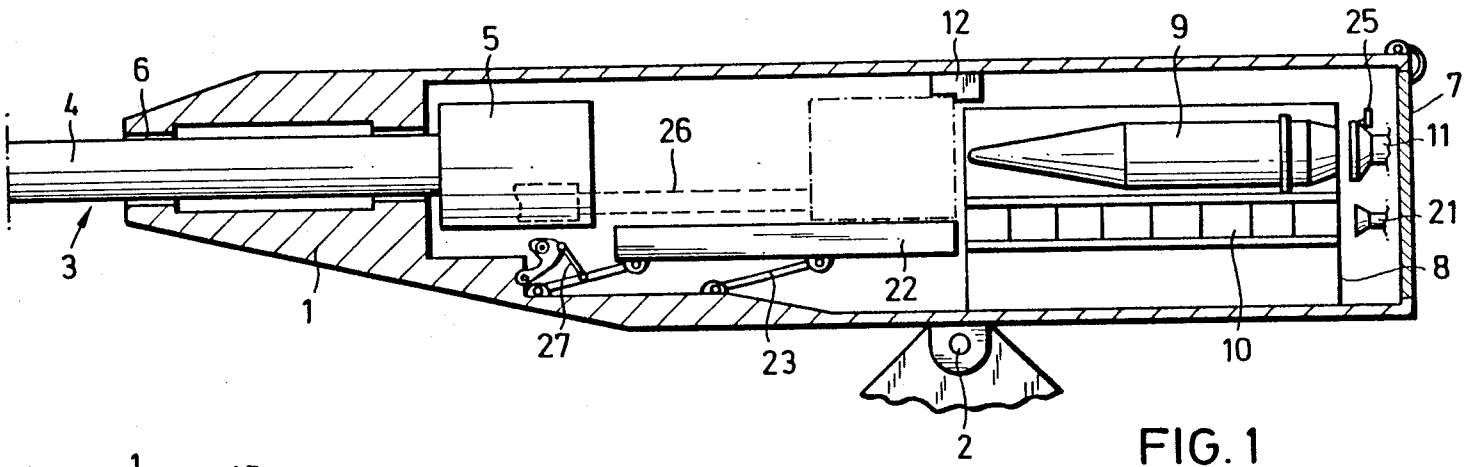
FIG. 1 is a schematic representation, partially in longitudinal section, of a weapon and ammunition carrier according to the preferred embodiment of the invention.
Figure 2:
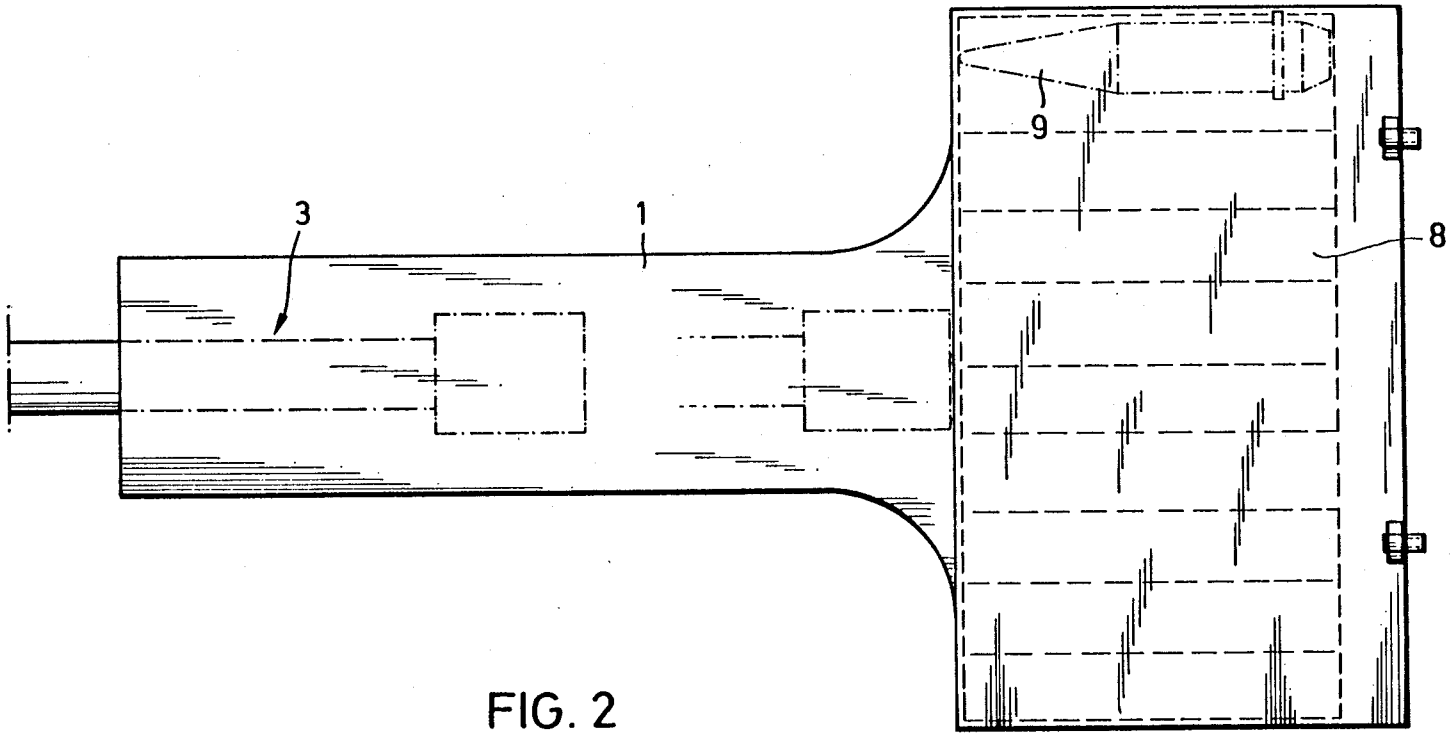
FIG. 2 is a top view of the weapon and ammunition carrier of FIG. 1.

The weapon and ammunition carrier according to the preferred embodiment of the invention includes a housing 1, which, in a top view, has the shape of a hammer or a T as shown in FIG. 2 and, when seen from the side, is generally flat as shown in FIG. 1. Housing 1 is pivotal about an elevation axis 2. The housing 1, which may be armored, accommodates a gun 3 which includes a gun tube or gun barrel 4 projecting from housing 1 and a breech ring 5 with a breech block disposed within housing 1. The front section of housing 1 is provided with slide bearings 6 for barrel 4 so that gun 3 is axially displaceable within housing 1 between a frontal firing position (shown in solid lines in FIG. 1) and a rear recoil position (partially shown in dotted lines in FIG. 1). The elevational adjustment of gun 3 is effected by way of housing 1 which is disposed on a rotatable undercarriage (not shown) for azimuthal adjustment. At least one ammunition supply hatch 7 is disposed on the rear of housing 1.

A magazine 8 is disposed in a rear portion of housing 1 extending transversely to the gun barrel axis. The magazine 8 and gun 3 are rigidly connected together by way of housing 1. The magazine 8 receives projectiles 9 in one plane and, in a plane disposed therebelow, separately from projectiles 9, propelling charges 10 are positioned. Charges 10 may be in modular form. The projectile 9 in the center position of magazine 8 is disposed in alignment with the gun barrel 4. The magazine 8 may be, for example, a known transverse belt type magazine, which is capable of alternatingly supplying different types of ammunition. At the rear of housing 1, coaxially with barrel 4, there is provided a projectile rammer 11 for the center projectile 9, which is loaded directly from the magazine 8 when the gun 3 is in the recoil position. Magazine 8 thus also serves as a loading tray for projectile 9, with the projectile rammer 11 being movable in a known manner by way of a drive (not illustrated) in the direction of the barrel axis. The drive is started by way of a suitable switch (not shown) when gun 3 reaches the recoil position.

In the recoil position of gun 3, there is provided a catching and holding device 12 for gun 3. Device 12 is composed of a plurality of (for example, three) abutment blocks 13 (see FIG. 3) fixed to and distributed about the circumference of housing 1. An abutment block 13 may be provided with a buffer 14, for example of hard rubber, facing the breech ring 5.

Figure 3:
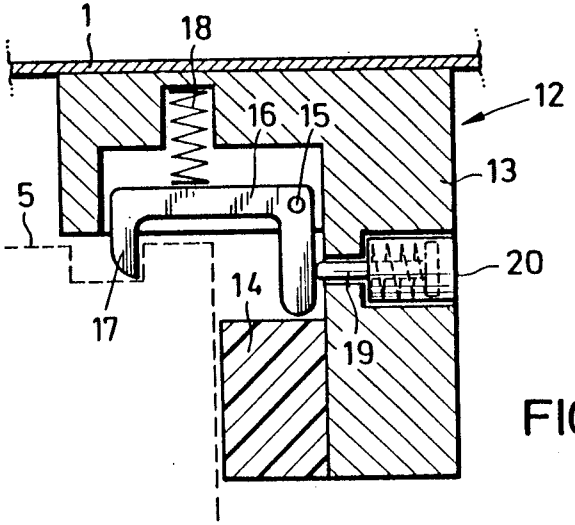
FIG. 3 is a detailed view of a portion of the weapon and ammunition carrier of FIG. 1.

With continuing reference to FIG. 3, an angle lever 16 equipped with a locking tab 17 is pivotally mounted at 15 in abutment block 13. The locking tab 17 projects radially from the abutment block 13 into the path of the breech ring 5. One arm of angle lever 16 is pre-tensioned with respect to the gun barrel axis by means of a spring 18. A rearwardly spring-tensioned plunger 19 which is coaxial with the barrel axis engages the other arm of angle lever 16. Plunger 19 is displaceable toward the gun barrel 4 against the force of the spring by way of a piston 20. When the gun 3, after a round has been fired or in order to fire the first round, moves or is moved into the recoil position, the rear edge of breech ring 5 initially pushes angle levers 16 outwardly against the force of springs 18, whereupon locking tabs 17 engage in corresponding recesses in breech ring 5. The elastic buffers 14, which dampen the impact of gun 3, then press breech ring 5 against locking tabs 17 so that gun 3 is detained in a predetermined axial position. At the end of the return stroke of the projectile ejector 11, after the ramming process for loading gun 3 has occurred, piston 20 can be charged with a pressure medium by way of an appropriate switching element (not shown) so that plunger 19 is pressed forward to release gun 3.

Additionally, a propelling charge rammer 21 is provided below projectile rammer 11 and is actuated similarly to projectile rammer 11. Propelling charge rammer 21 may be actuated separately from, or together with, and possibly in synchronism with, projectile rammer 11. Rammer 21 pushes a propelling charge module 10 from magazine 8 onto a propelling charge loading tray 22.

Although not shown the propelling charge loading tray 22 has a depression to accommodate propelling charge modules 10 and includes a pushing device actuated by an appropriate drive for pushing the propelling charges 10 disposed on the propelling charge tray 22 into gun 3. The starting and receiving position of the propelling charge loading tray 22 is below the axis of barrel 4, at the height of the magazine plane for propelling charges 10. The loading tray 22 is then pivoted forward by way of a parallelogram suspension 23 in such a manner that the propelling charges 10 become aligned with the gun barrel axis.

After gun 3 in the rear recoil position has been loaded with a projectile 9, the gun 3 is released and moved forward into the firing position, as follows: A switching element 25, fixed to the housing, is actuated by projectile rammer 11 once it is in its end position. A hydraulic recuperator 26 which, like a recoil brake, engages the breech ring 5 by way of barrel holders (not shown), then moves the gun 3 forward into the firing position, the weapon having been released by catching and holding device 12 at the end of the projectile loading process. During the forward motion of the weapon barrel, approximately 300 mm before the end of such forward run, the propelling charge loading tray 22 is, by means of a conventional, hydraulically actuated gripping device 27, lifted and pivoted into the loading position for the propelling charge module 10. During further forward movement of the barrel 3 the loading of the propelling charge module 10 is effected by means of a conventional pushing device in a setting process similar to that disclosed in U.S. Pat. No. 3,938,421. Shortly before the end of the forward movement of the barrel the wedge-type breach block is automatically locked in a non-illustrated, conventional manner. Immediately thereafter, propelling charge loading tray 22 is pivoted back into its starting position.

After firing of the shot, the barrel 4 recoils and is held by the catching and holding device 12 in the rearward recoil position for the time it takes for projectile rammer 11 to eject a projectile 9 from magazine 8 and ram it into barrel 4, until rammer 11 actuates switch element 25 to cause the barrel 4 to be advanced by recuperator 26. This again causes the propelling charges 10 to be loaded. The propelling charges 10 may either be transported by the propelling charge loading tray 22 after the starting position has been reached, or simultaneously with the movement of a projectile 9 from magazine 8, whereupon the wedge-type breech block is closed.

Barrel 4 has a relatively long recoil path of, for example 1.2 m. During the entire loading sequence, projectiles 9 are not tilted in any way; the angular position of projectiles 9 with respect to tube 4 is not changed until they are fired. Therefore a fully automatic loading sequence for separated ammunition at a high cadence is ensured.

It will be understood that the above description of the present invention is susceptible to various modifications, changes, and adaptations, and the same are intended to be comprehended within the meaning and range of equivalents of the appended claims.

What is claimed is:

1. A weapon and ammunition carrier for a gun having a barrel, comprising:

a housing on which said gun is mounted, said gun being displaceable with respect to said housing from an initial firing position to a recoil position, said housing being pivotally mounted about an elevation axis to elevate said gun;

an ammunition magazine in said housing and positioned adjacent said recoil position of said gun, said magazine including an upper level for accommodating projectiles in such a manner that a projectile disposed at a middle position in said upper level is aligned with said gun barrel, and a lower level for accommodating propelling charges, said magazine having a projectile rammer which ejects said projectiles from said upper level of said magazine and rams said projectiles into said gun barrel, and a propelling charge rammer which ejects said propelling charges from said lower level of said magazine;

catching and holding means for catching and holding said gun barrel in the recoil position;

means responsive to said projectile rammer for releasing said catching and holding means;

recuperator means for axially advancing said gun from the recoil position to the firing position; and loading tray means for transferring propelling charges from said magazine to said gun, said loading tray means including parallelogram suspension means for pivoting the loading tray means between a receiving position at the height of said lower level of said magazine and a charge loading position for said gun.

2. A weapon and ammunition carrier as defined in claim 1, wherein the housing, when seen in a top view is hammer shaped.

3. A weapon and ammunition carrier as defined in claim 1, further comprising a gripping device coupled with said parallelogram suspension means.

4. A weapon and ammunition carrier as defined in claim 1, wherein said loading tray means is pivoted into the loading position as said recuperator means axially advances said gun, and wherein said propelling charges are loaded into said gun as said recuperator means axially advances said gun.

5. A weapon and ammunition carrier as defined in claim 1, wherein the catching and holding means comprises abutments and releasable detente elements.

6. A weapon and ammunition carrier as defined in claim 1, wherein the housing, when seen in a top view, has a first elongated portion with an end region and a second elongated portion with a central region that is connected to the end region of the first elongated portion, the barrel extending from the first elongated portion and the ammunition magazine being disposed in the second elongated portion.

* * * * *